US010718331B2

(12) United States Patent
Moon et al.

(10) Patent No.: US 10,718,331 B2
(45) Date of Patent: Jul. 21, 2020

(54) COMPRESSOR HAVING A LUBRICATION SURFACE FORMED ON A ROLLER THEREOF

(71) Applicant: LG ELECTRONICS INC., Seoul (KR)

(72) Inventors: Seokhwan Moon, Seoul (KR); Yunhi Lee, Seoul (KR); Byeongchul Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 340 days.

(21) Appl. No.: 15/506,448

(22) PCT Filed: Sep. 2, 2015

(86) PCT No.: PCT/KR2015/009226
§ 371 (c)(1),
(2) Date: Feb. 24, 2017

(87) PCT Pub. No.: WO2016/043454
PCT Pub. Date: Mar. 24, 2016

(65) Prior Publication Data

US 2018/0223845 A1 Aug. 9, 2018

(30) Foreign Application Priority Data

Sep. 19, 2014 (KR) ..... 10-2014-0125139

(51) Int. Cl.
*F04C 18/356* (2006.01)
*F04C 29/02* (2006.01)
*F04C 23/00* (2006.01)

(52) U.S. Cl.
CPC ..... *F04C 18/3566* (2013.01); *F04C 29/023* (2013.01); *F04C 29/028* (2013.01); *F04C 23/008* (2013.01); *F04C 2250/20* (2013.01)

(58) Field of Classification Search
CPC ..... F04C 18/3566; F04C 2250/20; F04C 29/023; F04C 29/028
See application file for complete search history.

(56) References Cited

U.S. PATENT DOCUMENTS 2,232,951 A 2/1941 Kosian
4,086,042 A * 4/1978 Young ..... F04C 18/3566 418/139

(Continued)

FOREIGN PATENT DOCUMENTS

BE 655838 12/1964
CN 1174297 2/1998

(Continued)

OTHER PUBLICATIONS

Chinese Office Action dated Sep. 4, 2018 with English Translation.

(Continued)

*Primary Examiner* — Mary Davis
(74) *Attorney, Agent, or Firm* — KED & Associates LLP

(57) ABSTRACT

Disclosed is a compressor. A lubrication surface, which has the same curvature as an inner circumferential surface curvature of a cylinder and which has a predetermined circumference length, is formed on an outer circumferential surface of a roller contacting an inner circumferential surface of the cylinder. With such a configuration, since the outer circumferential surface of the roller contacting the inner circumferential surface of the cylinder come in surface-contact with each other, an oil film is formed between the roller and the cylinder with a wide area. This can reduce a frictional loss.

13 Claims, 10 Drawing Sheets

(56) References Cited

U.S. PATENT DOCUMENTS

| | | | | |
|---|---|---|---|---|
| 4,345,886 | A | 8/1982 | Nakayama et al. | |
| 4,507,067 | A | 3/1985 | Hansen | |
| 4,599,059 | A | 7/1986 | Hsu | |
| 6,132,195 | A * | 10/2000 | Ikoma | F04C 18/3564 418/67 |
| 6,132,915 | A | 10/2000 | Yoshino et al. | |
| 6,213,732 | B1 | 4/2001 | Fujio | |
| 2005/0129559 | A1 | 6/2005 | Hasegawa et al. | |

FOREIGN PATENT DOCUMENTS

| | | |
|---|---|---|
| CN | 102022337 | 4/2011 |
| CN | 201953658 | 8/2011 |
| CN | 102597525 | 7/2012 |
| CN | 102788019 | 11/2012 |
| EP | 1 209 357 | 5/2002 |
| GB | 2111595 | 7/1983 |
| JP | S58-187595 | 11/1983 |
| JP | H 07-259767 | 10/1995 |
| WO | WO 2010/087180 | 8/2010 |
| WO | WO 2011/038174 | 3/2011 |

OTHER PUBLICATIONS

European Search Report dated Apr. 11, 2018.
International Search Report dated Nov. 26, 2015 issued in Application No. PCT/KR2015/009226.
European Office Action dated Feb. 26, 2019.
European Office Action dated Oct. 11, 2019.

* cited by examiner

COMPRESSOR HAVING A LUBRICATION SURFACE FORMED ON A ROLLER THEREOF

CROSS-REFERENCE TO RELATED PATENT APPLICATIONS

This application is a U.S. National Stage Application under 35 U.S.C. § 371 of PCT Application No. PCT/KR2015/009226, filed Sep. 2, 2015, which claims priority to Korean Patent Application No. 10-2014-0125139, filed Sep. 19, 2014, whose entire disclosures are hereby incorporated by reference.

TECHNICAL FIELD

The present invention relates to a compressor, and more particularly, to a compressor having a plurality of contact points between a cylinder and a roller.

BACKGROUND ART

Generally, a compressor may be classified into a rotary type compressor and a reciprocating type compressor according to a refrigerant compression method. In the rotary type compressor, a volume of a compression space is varied as a piston performs a rotary motion or an orbiting motion in a cylinder. On the other hand, in the reciprocating type compressor, a volume of a compression space is varied as a piston performs a reciprocating motion in a cylinder. As the rotary compressor, a rotary compressor for compressing a refrigerant as a piston is rotated by using a rotational force of a motor part is well-known.

The rotary compressor is configured to compress a refrigerant using a rolling piston which executes an eccentric rotary motion at a compression space of a cylinder, and a vane for dividing the compression space of the cylinder into a suction chamber and a discharge chamber by contacting an outer circumferential surface of the rolling piston.

Such a rotary compressor may be classified into a single rotary compressor and a double rotary compressor according to the number of compression spaces. The double rotary compressor may include a type for forming a plurality of compression spaces by laminating cylinders each having a single compression space on each other, and a type for forming a plurality of compression spaces at a single cylinder. In the former case, a plurality of eccentric portions are formed at a rotational shaft with height differences, and are configured to alternately compress a refrigerant at two compression spaces and to discharge the compressed refrigerant, while the eccentric portions perform an eccentric rotary motion at the compression space of each cylinder. On the contrary, in the latter case, as shown in FIG. 1, a refrigerant is simultaneously compressed at two compression spaces V1 and V2 and then is discharged, while a roller performs a concentric rotary motion at a single cylinder 3 provided with an oval-shaped roller 2 at a rotational shaft 1. In the latter case, since the refrigerant is sucked, compressed and discharged in the two compression spaces V1 and V2 with the same phase, gas forces transmitted to a central region of the rotational shaft 1 are attenuated. As a result, a repulsive force in a radial direction may almost disappear, and vibration noise of the compressor may be reduced.

However, the conventional rotary compressor having the oval-shaped roller may have the following problems.

As the roller 2 rotates together with the rotational shaft 1, an outer circumferential surface of wing portions 2*a*, 2*b* formed at two sides of the roller 2 consecutively contacts an inner circumferential surface (3*a*) of the cylinder 3. In this case, since contact ends 2*a*1, 2*b*1 of the wing portions 2*a*, 2*b* come in point-contact with the inner circumferential surface (3*a*) of the cylinder 3, an oil film may not be smoothly formed and a frictional loss may be increased.

DISCLOSURE OF THE INVENTION

Therefore, an object of the present invention is to provide a rotary compressor capable of smoothly forming an oil film at a contact part between a roller and a cylinder.

Another object of the present invention is to provide a rotary compressor capable of preventing occurrence of a compression loss while an outer circumferential surface of a roller comes in surface-contact with a cylinder.

To achieve these and other advantages and in accordance with the purpose of the present invention, as embodied and broadly described herein, there is provided a compressor, including: a driving motor; a rotational shaft configured to transmit a rotational force of the driving motor; a cylinder installed at one side of the driving motor; a roller having an outer circumferential surface contacting an inner circumferential surface of the cylinder on at least two points, rotated by being provided at the rotational shaft, and concentric with the cylinder; and at least two vanes movably provided at the cylinder, contacting an outer circumferential surface of the roller, and configured to divide at least two compression spaces formed by the cylinder and the roller into a suction chamber and a compression chamber, wherein the roller is provided with a lubrication surface on its outer circumferential surface contacting the inner circumferential surface of the cylinder, the lubrication surface having the same radius from a rotation center of the roller.

To achieve these and other advantages and in accordance with the purpose of the present invention, as embodied and broadly described herein, there is also provided a compressor, including: a driving motor; a rotational shaft configured to transmit a rotational force of the driving motor; a cylinder installed at one side of the driving motor; a roller having an outer circumferential surface contacting an inner circumferential surface of the cylinder on at least two points, rotated by being provided at the rotational shaft, and concentric with the cylinder; and at least two vanes movably provided at the cylinder, contacting an outer circumferential surface of the roller, and configured to divide at least two compression spaces formed by the cylinder and the roller into a suction chamber and a compression chamber, wherein the roller is provided with a first section and a second section extending from the first section on its outer circumferential surface, the first section where a distance sum from the outer circumferential surface to two points on a line passing through a rotation center of the roller is gradually increased, the second section where the distance sum is gradually decreased.

To achieve these and other advantages and in accordance with the purpose of the present invention, as embodied and broadly described herein, there is also provided a compressor, including: a driving motor; a rotational shaft configured to transmit a rotational force of the driving motor; a cylinder installed at one side of the driving motor; a roller having an outer circumferential surface contacting an inner circumferential surface of the cylinder on at least two points, rotated by being provided at the rotational shaft, and concentric with the cylinder; and at least two vanes movably provided at the cylinder, contacting an outer circumferential surface of the roller, and configured to divide at least two compression spaces formed by the cylinder and the roller into a suction chamber and a compression chamber, wherein the roller is provided with at least two wing portions formed to extend in a radial direction on the basis of the rotational shaft, wherein an extended surface, where a distance sum from two points to the outer circumferential surface of the roller is increased, is formed on an outer circumferential surface of each of the wing portions, wherein the extended surface includes: a first curved surface spaced from the inner circumferential surface of the cylinder; and a second curved surface contacting the inner circumferential surface of the cylinder, and wherein a maximum curvature radius of the first curved surface is formed to be larger than a curvature radius of the second curved surface.

Assuming that a half circumference angle of a contact section of the roller contacting the inner circumferential surface of the cylinder, among the outer circumferential surface of the roller, is D and a circumference angle between a central part of the vane in a lengthwise direction and a compression starting angle is C, the half circumference angle of the contact section may satisfy a formula, $D \leq C$.

A suction opening may be formed at one side of the vane in a circumferential direction. And a circumference length of the contact section of the roller contacting the inner circumferential surface of the cylinder, among the outer circumferential surface of the roller, may be formed to be equal to or smaller than two times of a circumference length from the central part of the vane in a lengthwise direction to a farthest part of the suction opening from the vane.

An oil passage may be formed at the rotational shaft. And an oil hole, through which the contact section of the roller contacting the inner circumferential surface of the cylinder, among the outer circumferential surface of the roller, communicates with the oil passage, may be formed at the roller.

To achieve these and other advantages and in accordance with the purpose of the present invention, as embodied and broadly described herein, there is also provided a compressor, including: a driving motor; a rotational shaft configured to transmit a rotational force of the driving motor; a cylinder installed at one side of the driving motor; a roller having an outer circumferential surface contacting an inner circumferential surface of the cylinder on at least two points, rotated by being provided at the rotational shaft, and concentric with the cylinder; and at least two vanes movably provided at the cylinder, contacting an outer circumferential surface of the roller, and configured to divide at least two compression spaces formed by the cylinder and the roller into a suction chamber and a compression chamber, wherein an oil passage is formed at the rotational shaft, and wherein an oil hole, which communicates with the oil passage toward the outer circumferential surface of the roller contacting the inner circumferential surface of the cylinder, is formed at the roller.

An oil groove may be formed on the outer circumferential surface of the oil, so as to communicate with the oil hole.

The compressor of the present invention can have the following advantages.

The lubrication surface, which has the same curvature as an inner circumferential surface curvature of the cylinder and which has a predetermined circumference length, is formed on the outer circumferential surface of the roller contacting the inner circumferential surface of the cylinder. With such a configuration, since the outer circumferential surface of the roller contacting the inner circumferential surface of the cylinder come in surface-contact with each other, an oil film is formed between the roller and the cylinder with a wide area. This can reduce a frictional loss.

MODES FOR CARRYING OUT THE PREFERRED EMBODIMENTS

Reference will now be made in detail to the preferred embodiments of the present invention, examples of which are illustrated in the accompanying drawings. It will also be apparent to those skilled in the art that various modifications and variations can be made in the present invention without departing from the spirit or scope of the invention. Thus, it is intended that the present invention cover modifications and variations of this invention provided they come within the scope of the appended claims and their equivalents.

Description will now be given in detail of a compressor according to an embodiment, with reference to the accompanying drawings.

Figure 1:
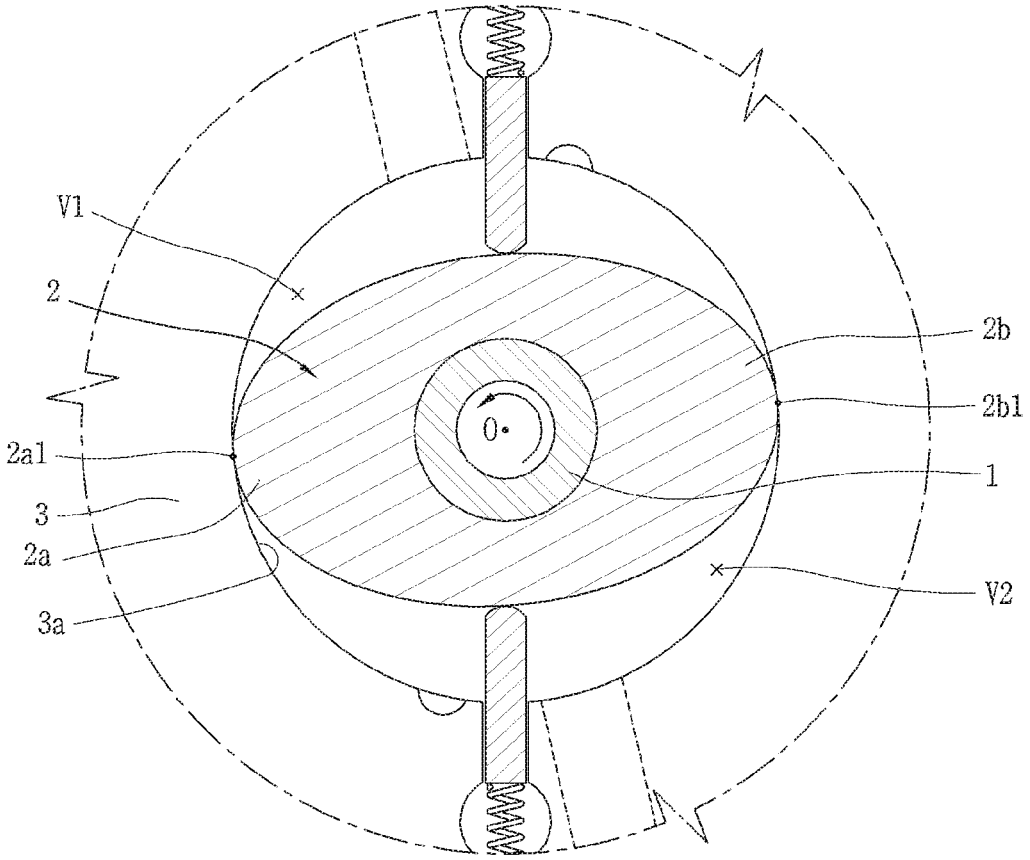
FIG. 1 CONVENTIONAL ART
FIG. 1 is a planar view illustrating a compression part of a rotary compressor having an oval-shaped roller in accordance with the conventional art.
Figure 2:
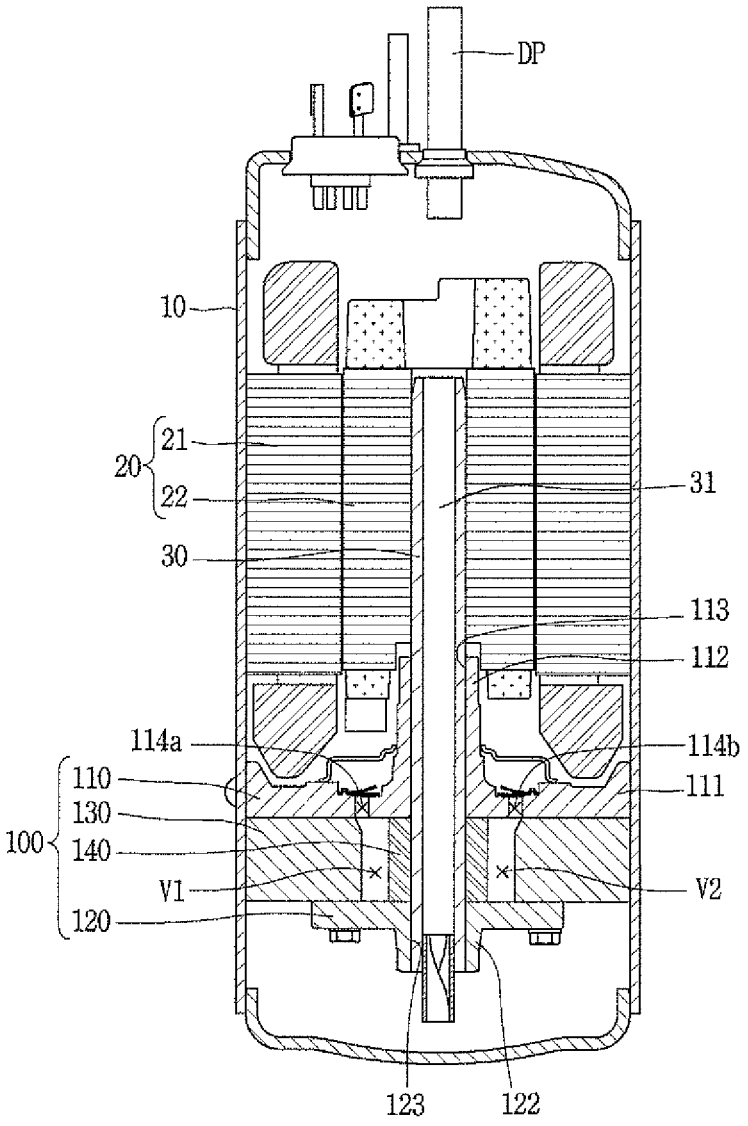
FIG. 2 is a longitudinal sectional view illustrating a rotary compressor according to the present invention.
Figure 3:
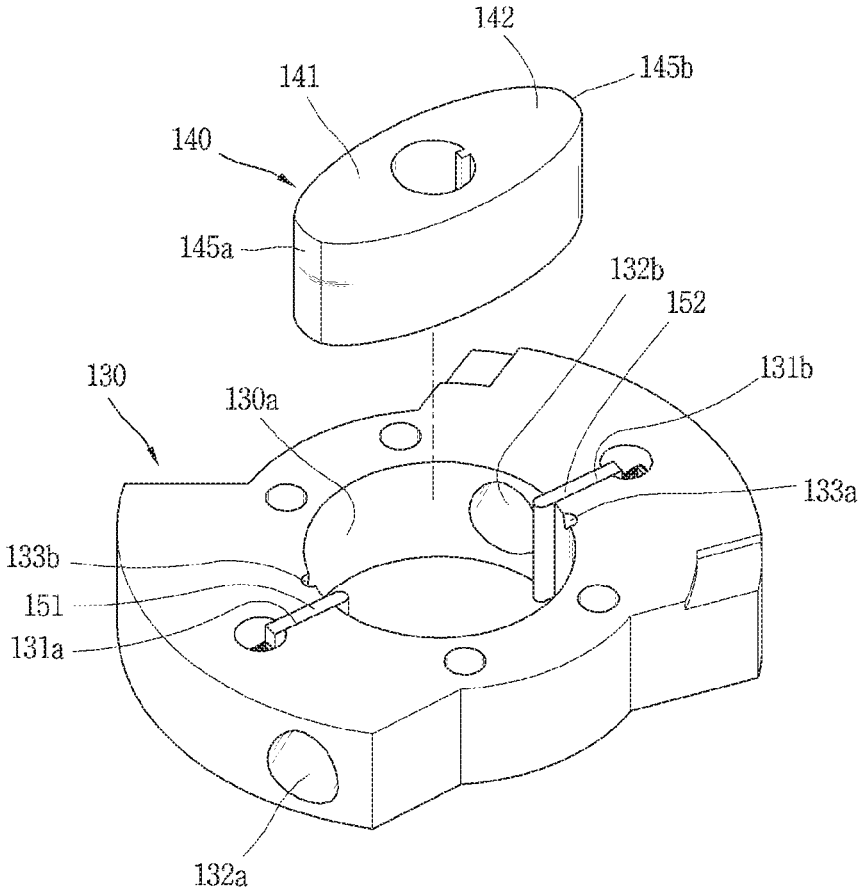
FIG. 3 is a disassembled perspective view illustrating a compression part of the rotary compressor of FIG. 2.
Figure 4:
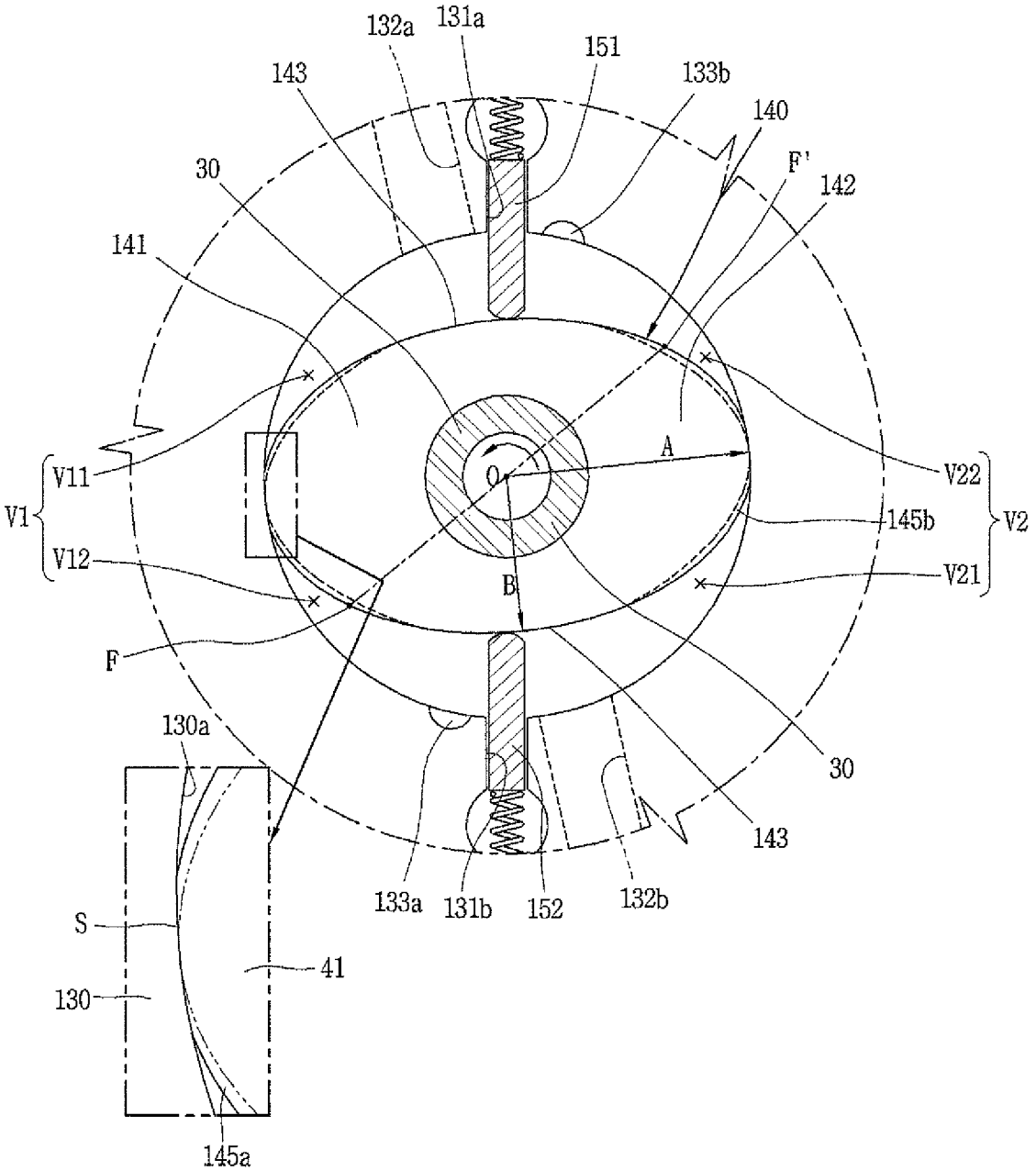
FIG. 4 is a planar view illustrating the compression part of the rotary compressor of FIG. 2.
Figure 5:
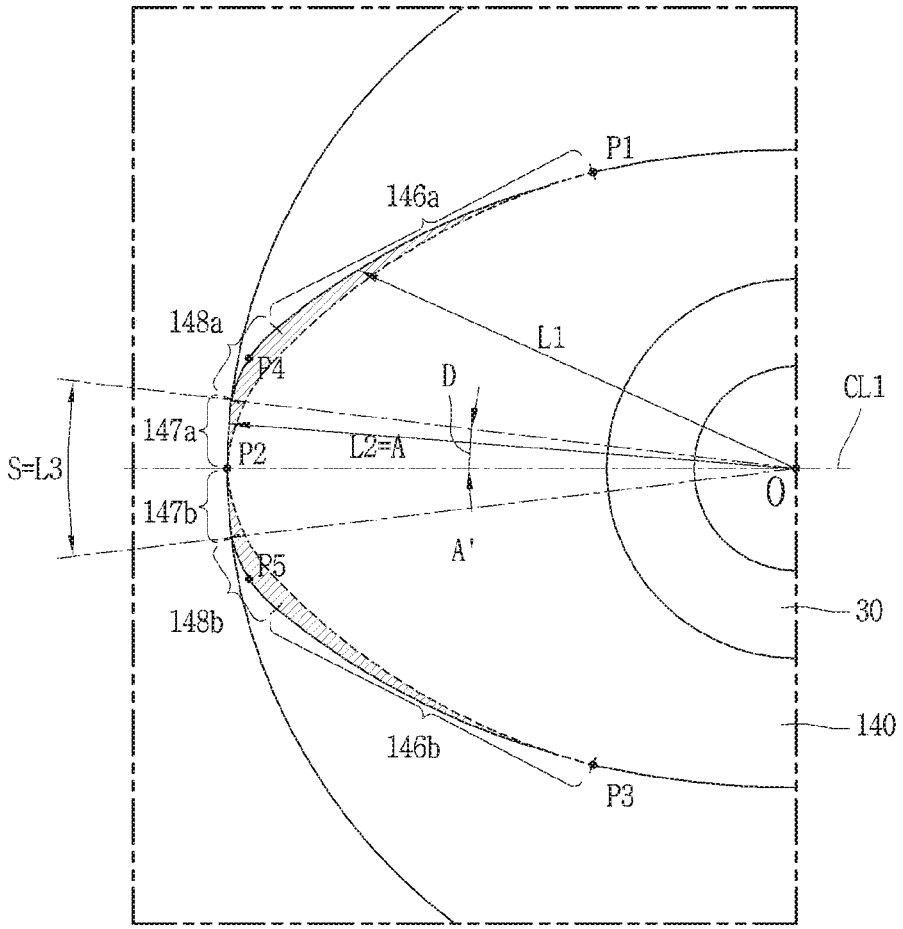
FIGS. 5 and 6 are views schematically illustrating a standard of an extended surface of a roller of FIG. 4.
Figure 6:
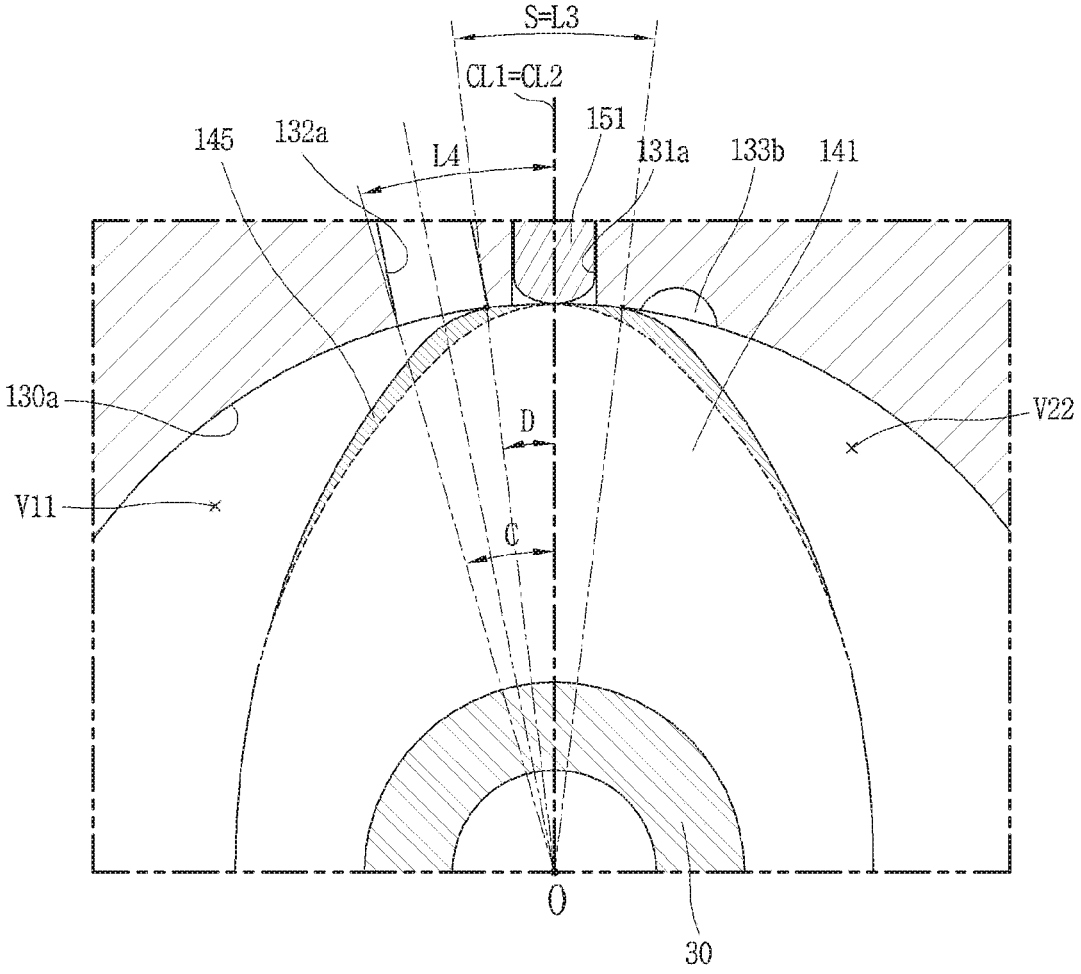

FIG. 3 is a disassembled perspective view illustrating a compression part of the rotary compressor of FIG. 2, FIG. 4 is a planar view illustrating the compression part of the rotary compressor of FIG. 2, and FIGS. 5 and 6 are views schematically illustrating a standard of an extended surface of a roller of FIG. 4.

As shown, in a rotary compressor according to an embodiment of the present invention, a motor part 20 may be installed in a casing 10, and a compression part 100 mechanically connected to the motor part 20 by a rotational shaft 30 may be installed below the motor part 20.

The motor part 20 may include a stator 21 forcibly-fixed to an inner circumferential surface of the casing 10, and a rotor 22 rotatably inserted into the stator 21. The rotational shaft 30 may be forcibly-coupled to the rotor 22.

The compression part 100 may include a main bearing 110 and a sub bearing 120 configured to support the rotational shaft 30; a cylinder 130 installed between the main bearing 110 and the sub bearing 120, and forming a compression space; a roller 140 formed at the rotational shaft 30, and performing a rotary motion at a compression space (V) of the cylinder 130; and vanes 151, 152 contacting an outer circumferential surface of the roller 140, and movably-coupled to the cylinder 130. The roller 140 may contact an inner circumferential surface 130*a* of the cylinder 130 on at least two points, thereby dividing the compression space (V)

of the cylinder 130 into at least two regions. And the vanes 151, 152 may be provided in at least two in number, thereby dividing each of the at least two compression spaces into a suction chamber and a compression chamber. Hereinafter, a compression part having two compression spaces will be explained.

The main bearing 110 is formed to have a disc shape, and a side wall portion 111 may be formed at an edge of the main bearing 110 so as to be shrinkage-fit or welded to an inner circumferential surface of the casing 10. A main shaft accommodating portion 112 may upward protrude from a central part of the main bearing 110, and a shaft accommodating hole 113 for inserting and supporting the rotational shaft 30 may be penetratingly-formed at the main shaft accommodating portion 112. A first discharge opening 114*a* and a second discharge opening 114*b*, connected to a first compression space (V1) and a second compression space (V2) to be explained later and configured to discharge a refrigerant compressed in the compression spaces V1 and V2 into an inner space 11 of the casing 10, may be formed at one side of the main shaft accommodating portion 112. The first discharge opening 114*a* and the second discharge opening 114*b* may be formed in a circumferential direction with an interval of 180°. In some cases, the first discharge opening 114*a* and the second discharge opening 114*b* may be formed at a sub bearing 120.

The sub bearing 120 may be formed to have a disc shape, and may be bolt-coupled to the main bearing 110 together with the cylinder 130. When the cylinder 130 is fixed to the casing 10, the sub bearing 120 may be bolt-coupled to the cylinder 130 together with the main bearing 110. On the other hand, when the sub bearing 120 is fixed to the casing 10, both the cylinder 130 and the main bearing 110 may be bolt-coupled to the sub bearing 120.

A sub shaft accommodating portion 122 may downward protrude from a central part of the sub bearing 120, and a shaft accommodating hole 123 for supporting a lower end of the rotational shaft 30 may be penetratingly-formed at the sub shaft accommodating portion 122, in a concentric manner to the shaft accommodating hole 113 of the main bearing 110.

An inner circumferential surface 130*a* of the cylinder 130 may have a ring shape of a right circle. A first vane slot 131*a* and a second vane slot 131*b*, into which a first vane 151 and a second vane 152 to be explained later are movably inserted, may be formed at two sides of an inner circumferential surface of the cylinder 130, in a radial direction. The first vane slot 131*a* and the second vane slot 131*b* may be formed in a circumferential direction with an interval of 180°.

A first suction opening 132*a* and a second suction opening 132*b* may be formed at one side of the first vane slot 131*a* and the second vane slot 131*b*, in a circumferential direction. The first suction opening 132*a* and the second suction opening 132*b* may be formed in a circumferential direction with an interval of 180°. The first suction opening 132*a* and the second suction opening 132*b* may be formed at the cylinder 130. However, in some cases, the first suction opening 132*a* and the second suction opening 132*b* may be formed at the sub bearing or the main bearing.

A first discharge guide groove 133*a* and a second discharge guide groove 133*b* may be formed at another side of the first vane slot 131*a* and the second vane slot 131*b* in a circumferential direction, in correspondence to the first discharge opening 114*a* and the second discharge opening 114*b* of the main bearing, respectively. The first discharge guide groove 133*a* and the second discharge guide groove 133*b* may be formed in a circumferential direction with an interval of 180°. In some cases, the first discharge guide groove 133*a* and the second discharge guide groove 133*b* may not be formed.

The roller 140 may be integrally formed at the rotational shaft 30, or may be coupled to the rotational shaft 30 after being separately fabricated. The roller 140 may be provided with a first wing portion 141 and a second wing portion 142 long-extending to right and left directions. The first wing portion 141 and the second wing portion 142 may be formed to be symmetrical to each other in a circumferential direction with an interval of 180°. Hereinafter, the first wing portion will be explained.

The first wing portion 141 may be formed to have an entire semi-elliptical shape. However, the first wing portion 141 may be provided with a first extended surface 145*a* at its end contacting the inner circumferential surface 130*a* of the cylinder 130, such that the first extended surface 145*a* surface-contacts the inner circumferential surface 130*a* of the cylinder 130, more precisely, the first extended surface 145*a* is spaced from the inner circumferential surface 130*a* of the cylinder 130 with a micro gap. The second wing portion 142 may be also provided with a second extended surface 145*b* symmetrical to the first extended surface 145*a*. In some cases, only one of the first extended surface and the second extended surface may be formed. Hereinafter, will be explained the first extended surface in a case where the first and second extended surfaces are formed on the right and left of a long-axis direction central line.

As shown in FIGS. 4 and 5, the extended surfaces 145*a*, 145*b* may be formed such that a sum of distances from two points (F, F') passing through a rotation center (O) of the roller 140 to the outer circumferential surface of the roller 140 (hereinafter, will be referred to as a 'distance sum') thereof is larger than that in a region rather than the extended surfaces 145*a*,145*b*. That is, the first extended surface 145*a* may be formed from a first point (P1) among an outer circumferential surface of the first wing portion 141, to a second point (P2) through which a long-axis direction central line (CL1) passes, and from the second point (P2) to a third point (P3) among the opposite outer circumferential surface of the first wing portion 141. The first point (P1) and the third point (P3) are formed to have the same circumference length on the basis of the second point (P2). For reduction of a suction volume, the first extended surface 145*a* is preferably formed to be closer to the end of the first wing portion 141, if it is smoothly connected to the outer circumferential surface of the roller except for the first extended surface 145*a*.

An increase portion 146*a* and a decrease portion 147*a* are formed between the first point (P1) and the second point (P2), and an increase portion 146*b* and a decrease portion 147*b* are formed between the second point (P2) and the third point (P3). The increase portions 146*a*, 146*b* mean sections where the distance sum is gradually increased from the first point (P1) and the third point (P3) toward the second point (P2), respectively. And the decrease portions 147*a*, 147*b* mean sections consecutively formed to the increase portions 146*a*, 146*b*, and where the distance sum is gradually decreased. The increases portions 146*a*, 146*b* are referred to as first sections, and the decreases portions 147*a*, 147*b* are referred to as second sections. That is, a fourth point (P4) where the distance sum is variable may be formed between the first point (P1) and the second point (P2), and a fifth point (P5) where the distance sum is variable may be formed between the second point (P2) and the third point (P3). More specifically, the increase portion 146*a* where the distance sum is gradually increased may be formed from the first point (P1) to the fourth point (P4), and the decrease portion 147*a* where the distance sum is gradually decreased may be formed from the fourth point (P4) to the second point (P2). The increase portion 146*a* where the distance sum is gradually increased may be formed from the third point (P3) to the fifth point (P5), and the decrease portion 147*b* where the distance sum is gradually decreased may be formed from the fifth point (P5) to the second point (P2).

A connection portion 148*a* is formed between the increase portion 146*a* and the decrease portion 147*a*, and a connection portion 148*b* is formed between the increase portion 146*b* and the decrease portion 147*b*. Each of the connection portions 148*a*, 148*b* may be formed to have a curved surface having a tangent line. With such a configuration, each of the connection portions 148*a*, 148*b* may be defined as a region from a point where an increase width of the distance sum starts to be decreased, to a point where the outer circumferential surface of the roller contacts the inner circumferential surface of the cylinder.

The fourth point (P4) may be positioned at a central part of the connection portion 148*a*, and the fifth point (P5) may be positioned at a central part of the connection portion 148*b*.

The extended surfaces 145*a*, 145*b* may be implemented as a first curved surface spaced from an inner circumferential surface of the cylinder, and a second curved surface contacting the inner circumferential surface of the cylinder. The first curved surface may be the same as the outer circumferential surface of the roller from a starting point of the increase portion to the end of the connection portion, and the second curved surface may be the same as an outer circumferential surface of the decrease portion. A maximum curvature radius of the first curved surface may be larger than a curvature radius of the second curved surface.

The increase portions 146*a*, 146*b* may be spaced from the inner circumferential surface 130*a* of the cylinder 130, since a distance (L1) from the rotation center (O) of the roller to an outer circumferential surface of the increase portions 146*a*, 146*b* is always smaller than a radius (A) of the cylinder. The distance (L1) from the rotation center (O) of the roller to the outer circumferential surface of the increase portions 146*a*, 146*b* is not the same, but is gradually increased towards the decrease portions 147*a*, 147*b*.

The decrease portions 147*a*, 147*b* may contact the inner circumferential surface 130*a* of the cylinder 130, since a distance (L2) from the rotation center (O) of the roller to the outer circumferential surface of the decrease portions 147*a*, 147*b* is almost the same as the radius (A) of the cylinder. As the decrease portions 147*a*, 147*b* positioned at two sides of the second point (P2) come in surface-contact with the inner circumferential surface 130*a* of the cylinder 130, a lubrication section (hereinafter, will be referred to as a lubrication surface) (S) may be formed. Assuming that a half circumference angle of the lubrication surface (S) is D and a circumference angle from a central part of the vane in a lengthwise direction to a compression starting time point (i.e. compression starting angle) is C, the half circumference angle of the lubrication surface (S) may be formed to satisfy a formula, D C.

That is, as shown in FIG. 6, a circumference length (L3) (2D) of the lubrication surface (S) is preferably formed to be the same as or smaller than a circumference length (L4) from a lengthwise central line (CL2) of the first vane to the end of the first suction opening 132*a* in a circumferential direction, in a state where a long-axis direction central line (CL1) of the first wing portion 141 is consistent with the lengthwise central line (CL2) of the first vane 151 to be explained later, as the long-axis direction central line (CL1) of the first wing portion 141 is positioned at 0° on the basis of a crank angle.

If the half circumference angle (D) of the lubrication surface (S) is two times larger than the compression starting angle (C), one end of the lubrication surface (S) (i.e., a front end based on a rotation direction of the roller) is overlapped with the first suction opening 132*a*, in a state where the long-axis direction central line (CL1) of the first wing portion 141 is positioned at 0° on the basis of a crank angle. Accordingly, a compression loss due to a volume loss may occur. However, if the half circumference angle (D) of the lubrication surface (S) is the same as the maximum compression starting angle (C) from the lengthwise central line (CL2) of the first vane 151, the front end of the lubrication surface (S) is disposed at the same position as the end of the first suction opening 132*a* in a circumferential direction, in a state where the first wing portion 141 is positioned at 0° on the basis of a crank angle. In this case, a compression loss does not occur, since the roller 140 does not perform a compression operation from 0° to the compression starting angle.

The lubrication surface (S), which comes in surface-contact with the inner circumferential surface 130*a* of the cylinder 130, means an increased sectional surface of the roller 140. In case of a cylinder having the same inner diameter, this means that a compression space is reduced. Thus, an inner diameter or a height of the cylinder 130 should be increased, in order to obtain the same compression spaces V1 and V2 as those in the conventional rotary compressor having an oval-shaped roller which point-contacts with a cylinder. The following formula 1 is used to obtain an inner diameter of the cylinder, i.e., a radius of the lubrication surface for obtaining a proper compression space according to a circumference angle.

The distance (L2) from the rotation center (O) of the roller to the outer circumferential surface of the decrease portions 147*a*, 147*b*, i.e., a radius (A') of the lubrication surface is obtained as follows.

Assuming that a long-axis radius of the roller is A and a short-axis radius of the roller is B, the radius (A') of the lubrication surface may be obtained as follows.

$$A' = \sqrt{\frac{A^2B^2}{\cos^2 D(A^2\tan^2 D + B^2)}} \quad \text{[Formula 1]}$$

A volume of a compression space is obtained based on the radius of the lubrication surface, and a height of the cylinder and the roller satisfying the obtained volume is obtained as follows. Assuming that the existing height of the cylinder is H and a new height of the cylinder is H', the new height (H') of the cylinder is obtained as follows.

$$H' = \frac{1}{2}\frac{\pi A^2 H - \pi ABH}{A'D - ABD - AB\sin(D)\cos(D)} \quad \text{[Formula 2]}$$

As the second wing portion 142 is formed to be symmetrical to the first wing portion 141, only the first wing portion 141 will be explained hereinafter.

The vanes 151, 152 may include a first vane 151 slidably-inserted into the first vane slot 131*a*, and a second vane 152 slidably-inserted into the second vane slot 131*b*. The first vane 151 and the second vane 152 may be formed in a circumferential direction with an interval of 180° like the first vane slot 131*a* and the second vane slot 131*b*. With such a configuration, the first vane 151 divides a suction chamber (V11) of the first compression space (V1) and a compression chamber (V22) of the second compression space (V2) from each other, and the second vane 152 divides a suction chamber (V21) of the second compression space (V2) and a compression chamber (V12) of the first compression space (V1) from each other.

Unexplained reference numeral 143 denotes a compression surface which forms a compression chamber as an outer circumferential surface of the roller is spaced from an inner circumferential surface of the cylinder.

Effects of the rotary compressor according to an embodiment are as follows.

If the rotor 22 of the motor part 20 and the rotational shaft 30 coupled to the rotor 22 rotate as a power is supplied to the motor part 20, the roller 140 rotates together with the rotational shaft 30, thereby simultaneously sucking a refrigerant into the first compression space (V1) and the second compression space (V2) of the cylinder 130. The refrigerant is simultaneously compressed by the roller 140, the first vane 151, and the second vane 152, and is simultaneously discharged to the inner space 11 of the casing 10 through the first discharge opening 114*a* and the second discharge opening 114*b* of the main bearing 110. Such a compression operation and a discharge operation are repeatedly performed.

With such a configuration, a refrigerant is simultaneously compressed in the first compression space (V1) and the second compression space (V2), so gas forces transmitted to a central part of the rotational shaft are attenuated. As a result, a repulsive force in a radial direction may become almost zero, and thus vibrations of the compressor may be significantly reduced.

The lubrication surface (S), which has the same curvature as an inner circumferential surface curvature of the cylinder 130 and which has a predetermined circumference length, may be formed on the outer circumferential surface of the roller 140 contacting the inner circumferential surface 130*a* of the cylinder 130. More specifically, the lubrication surface (S) may be formed on the outer circumferential surface of the first wing portion 141 and the second wing portion 142 of the roller 140, in a symmetrical manner based on the long-axis direction central line (CL1) of each wing portion. With such a configuration, the outer circumferential surface of the first wing portion 141 and the second wing portion 142 comes in surface-contact with the inner circumferential surface 130*a* of the cylinder 130 within a predetermined section, and thus an oil film is formed on a wide area between the roller 140 and the cylinder 130. This can reduce a frictional loss between the roller 140 and the cylinder 130.

Figure 7:
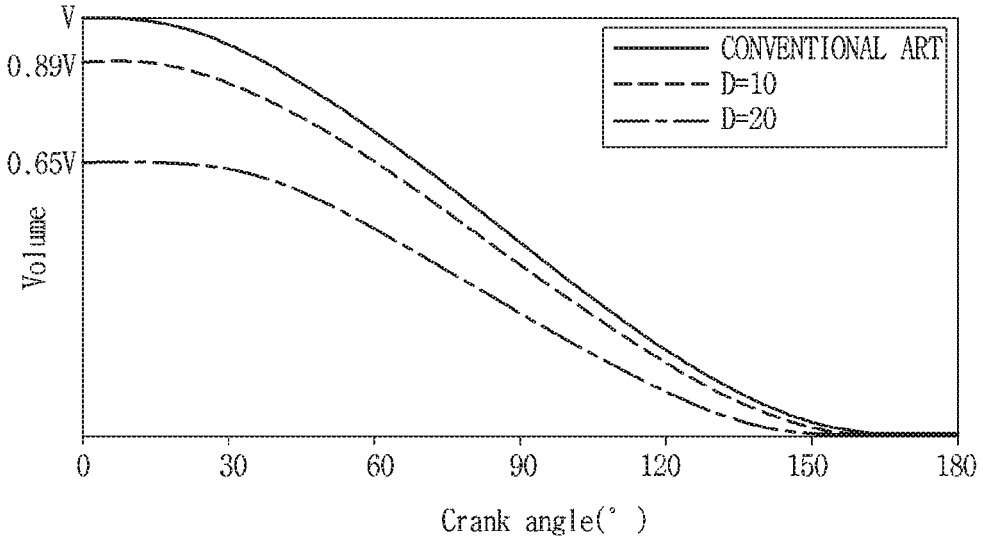
FIG. 7 is a graph comparing a volume change of a compression chamber according to an area of a lubrication surface in a roller according to this embodiment, with that in the conventional roller.

Since the lubrication surface (S) is formed at each of the first wing portion 141 and the second wing portion 142 of the roller 140, a sectional area of the first wing portion 141 and the second wing portion 142 is increased. Thus, if the cylinder 130 has the same height, a volume of each compression space may be more reduced than in a case where no lubrication surface is formed. However, as shown in FIG. 7, from 0° where the long-axis direction central line (CL1) of the roller 140 is consistent with the lengthwise central line (CL2) of the vane to the compression starting angle (about 20° in FIG. 5), a compression is not substantially executed even if the roller 140 rotates. A front end of the lubrication surface (S) is preferably formed not to protrude from the end of the first suction opening 132*a* in a circumferential direction. More specifically, when the half circumference angle (D) of the lubrication surface (S) is not larger than the compression starting angle (C) from the lengthwise central line (CL2) of the first vane to the end of the first suction opening, based on the rotation center (O) of the roller, a compression loss does not substantially occur. That is, in the conventional oval-shaped roller which point-contacts a cylinder, a volume change is already started before the roller arrives at the compression starting angle. In this case, a substantial compression does not occur, since the suction opening is in an open state. On the other hand, in the oval-shaped roller which surface-contacts the cylinder according to an embodiment of the present invention, when the half circumference angle (D) of the lubrication surface (S) is 10° and 20°, a volume change of the compression chamber occurs at a time point close to a substantial compression starting point. This may mean that a compression loss does not substantially occur in this embodiment, even if a volume of the compression chamber at 0° is reduced.

If a volume of the first compression space (V1) and the second compression space (V2) is increased as a height of the cylinder 130 and the roller 140 is increased, a suction volume at the compression starting angle may be increased to increase volume efficiency.

Figure 8:
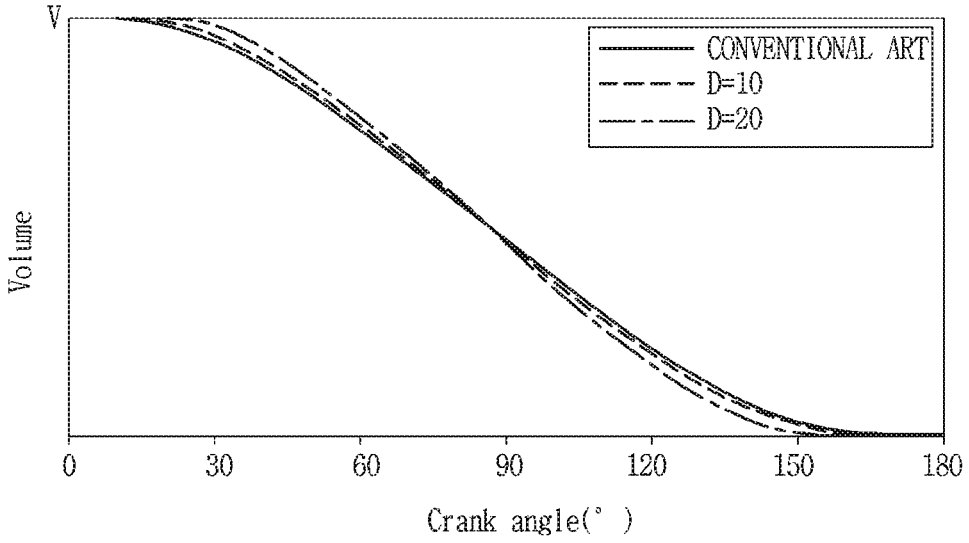
FIG. 8 is a graph comparing a volume change of a compression chamber according to an area of a lubrication surface in a roller according to this embodiment where a height of a cylinder and the roller is increased, with that in the conventional roller.

FIG. 8 is a graph comparing a volume change of a compression chamber according to an area of a lubrication surface in a roller according to this embodiment where a height of a cylinder and the roller is increased, with that in the conventional roller.

As shown, when the half circumference angle (D) of the lubrication surface (S) is 10° and 20°, there is no change in volume up to a crank angle (about 15°). However, from about 20° (the compression starting time point) to about 90° where a compression is being executed, a volume of the compression space is high. More specifically, when the half circumference angle (D) is 10°, the volume of the compression space is more increased than in the conventional case, by 0.4%. And when the half circumference angle (D) is 20°, the volume of the compression space is more increased than in the conventional case, by 2.3%.

Hereinafter, a roller according to another embodiment of the present invention will be explained.

Figure 9:
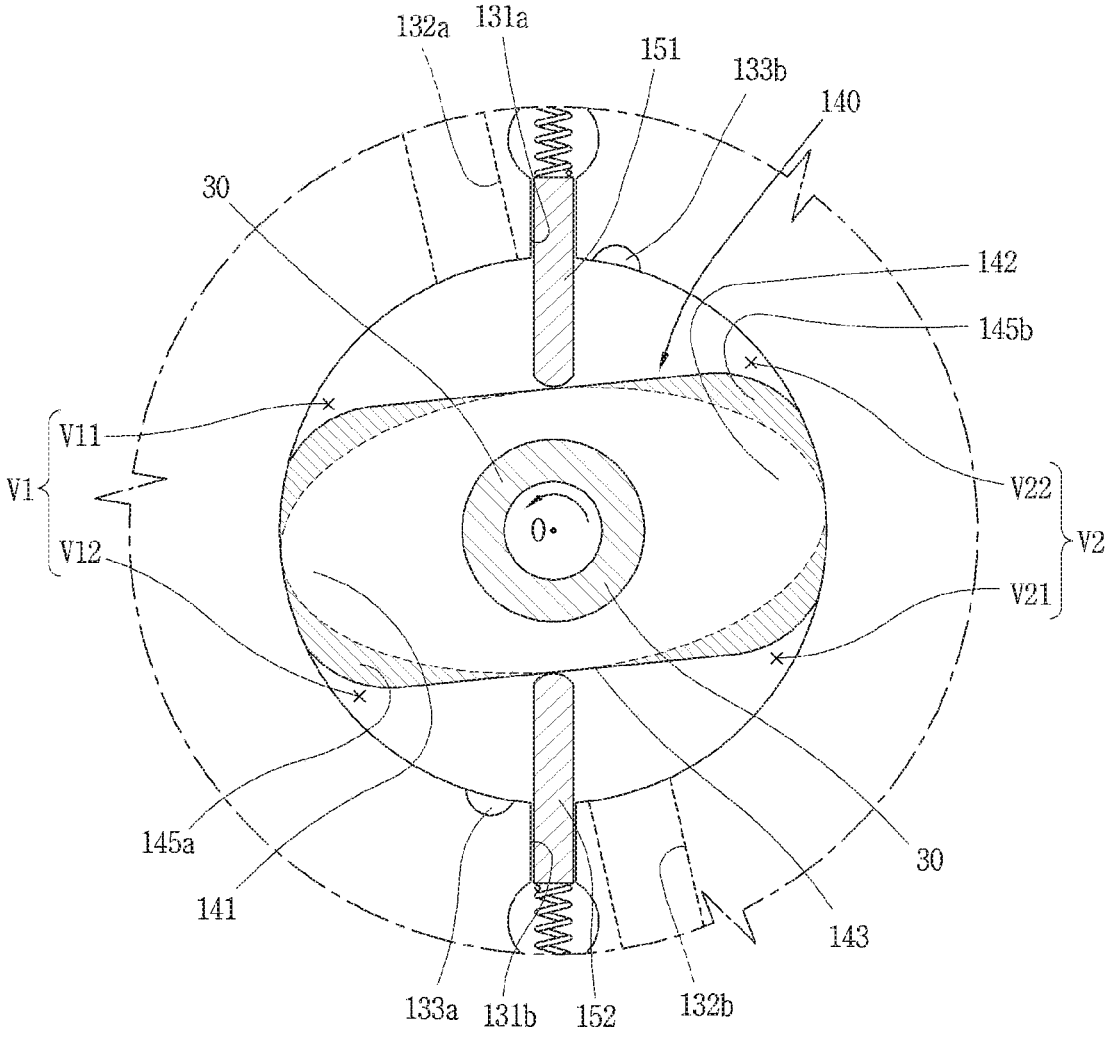
FIGS. 9 to 11 are planar views illustrating rollers of a rotary compressor according to other embodiments of the present invention.
Figure 10:
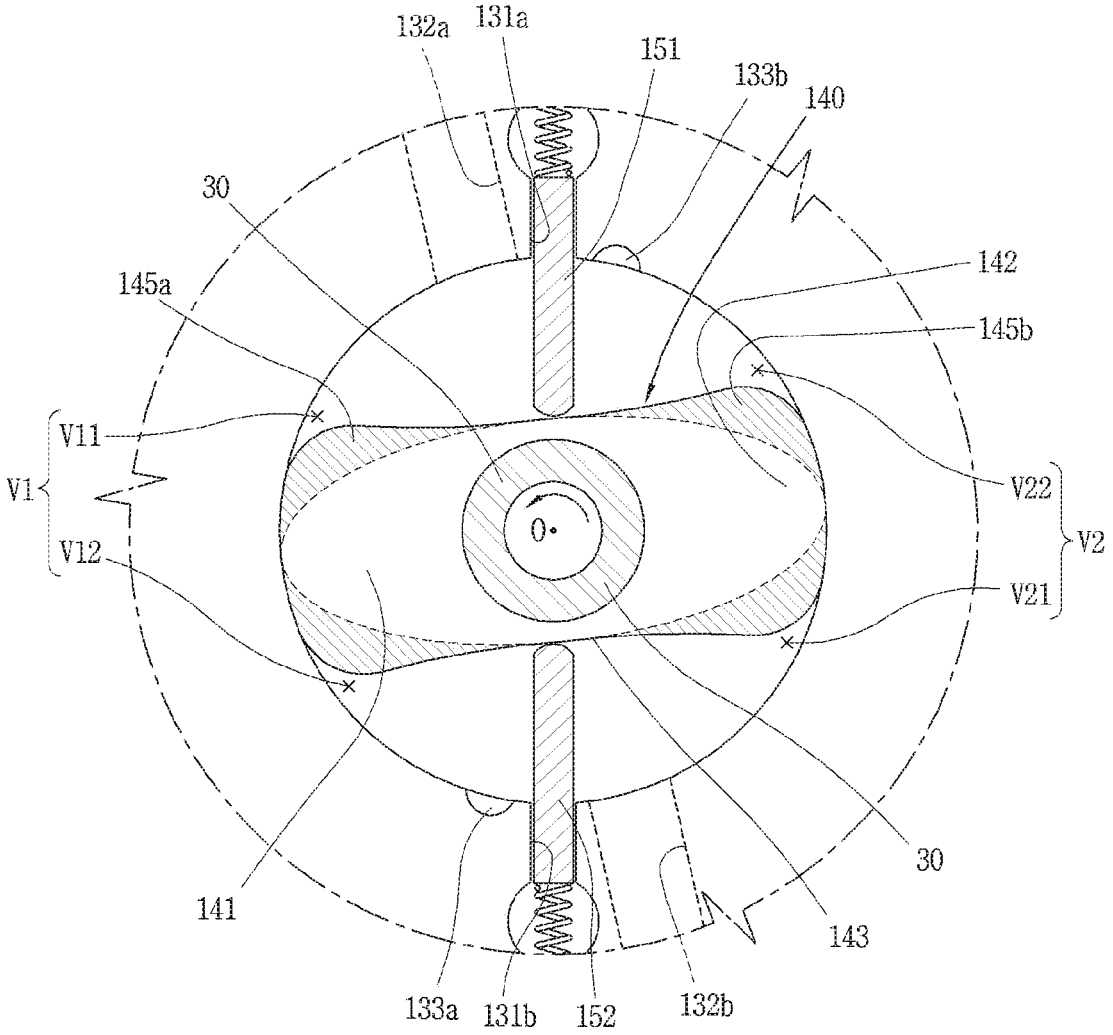

That is, in the aforementioned embodiment, the compression surface 143, formed between the extended surface 145*a* of the first wing portion 141 and the extended surface 145*b* of the second wing portion 142, and spaced from the inner circumferential surface of the cylinder, is formed to have an oval shape. However, in this embodiment, the compression surface 143 may be formed such that its outer circumferential surface has a straight line shape as shown in FIG. 9, or may be formed such that its circumferential surface has a concaved oval shape or a circular shape toward a rotation center of the roller, as shown in FIG. 10.

When the compression surface 143 is formed such that its outer circumferential surface has a shape of a straight line or a concaved space, a volume of the compression space is more increased than when the compression surface 143 is formed to have an oval shape or a convex shape. As the volume of the compression space is increased, compression efficiency can be enhanced.

Hereinafter, a roller according to still another embodiment of the present invention will be explained.

Figure 11:
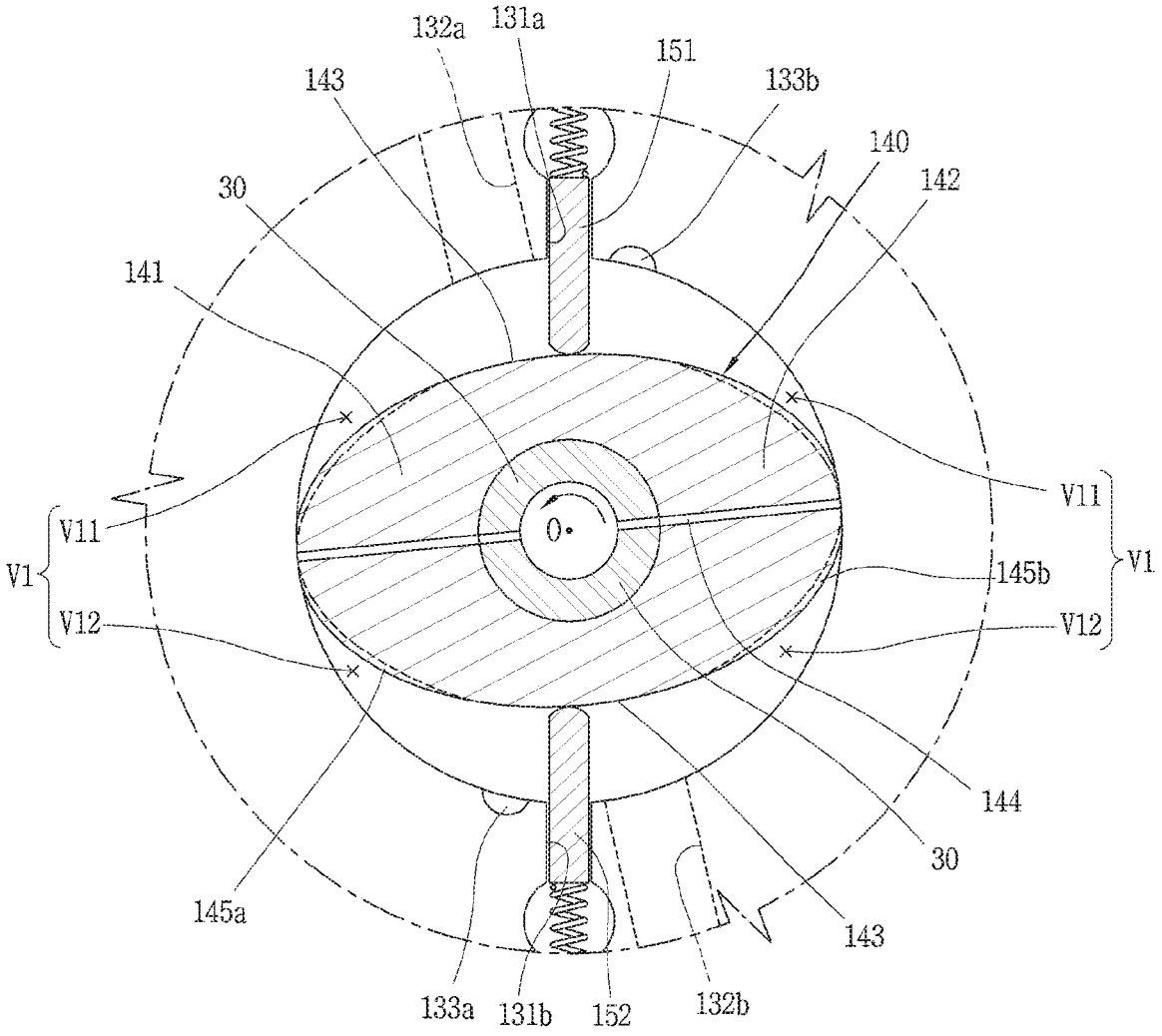

As shown in FIG. 11, an oil hole 144 may be additionally formed at the roller 140 such that a larger amount of oil is introduced into the lubrication surface (S). For this, the oil hole 144 may be penetratingly-formed at an oil passage 31 provided in the rotational shaft 30, toward the lubrication surface (S) of the first wing portion 141. An oil groove (not shown), configured to distribute oil introduced into the lubrication surface (S) through the oil hole 144, to an entire area of the lubrication surface (S), may be further formed at the lubrication surface (S) of the first wing portion 141. The oil groove may be formed to communicate with the end of the oil hole 144.

In the aforementioned embodiment, in a case where the lubrication surface (S) is formed at each of the first wing portion 141 and the second wing portion 142, the oil hole 144 is formed such that the oil passage 31 communicates with the lubrication surface (S). In some cases, the oil hole 144 may be penetratingly-formed at a contact part between the first wing portion 141 and the second wing portion 142, or at the periphery of the contact part, when the first wing portion 141 and the second wing portion 142 come in point-contact with each other, in a state where no lubrication surface is formed. In this case, an oil groove (not shown) may be formed at the first wing portion 141 and the second wing portion 142, so as to communicate with the oil hole 144.

In the case where the oil hole and the oil groove are formed at the first wing portion and the second wing portion, oil sucked through the oil passage is partially introduced between the roller and the cylinder, through the oil hole. As a region between the roller and the cylinder is lubricated by the oil, a fictional loss inside the compression part is reduced to enhance a compression performance.

The invention claimed is:

1. A compressor, comprising:

a driving motor;

a rotational shaft configured to transmit a rotational force of the driving motor;

a cylinder installed at one side of the driving motor;

a roller having an outer circumferential surface contacting an inner circumferential surface of the cylinder, rotated by the rotational shaft, and concentric with the cylinder; and at least two vanes movably provided at the cylinder, contacting the outer circumferential surface of the roller, and configured to divide at least two compression spaces formed by the cylinder and the roller into a suction chamber and a compression chamber, wherein the roller includes a lubrication surface provided on the outer circumferential surface of the roller in surface-contact with the inner circumferential surface of the cylinder, wherein the lubrication surface has a same radius from a rotation center of the roller and is formed on both sides of a line passing through the rotation center of the roller and two points on a long axis of an ellipse in a circumferential direction, wherein the roller includes a plurality of compression surfaces provided on the outer circumferential surface of the roller spaced apart from the inner circumferential surface of the cylinder to form the compression chamber, wherein an increase portion having a distance sum of distances from two points located at a same distance on both sides of the line passing through the rotation center of the roller to an arbitrary point on the outer circumferential surface of the roller being gradually increased, and a decrease portion extending from the increase portion and having the distance sum being gradually decreased to the distance sum of the two points that make up the ellipse, are formed on the outer circumferential surface of the roller, and wherein the distance sums that are measured on the outer circumferential surface of the roller starting at a location closer to the minor axis are compared to the distance sums that are measured closer toward the major axis.

2. The compressor of claim 1, wherein the increase portion is formed such that a distance from the rotation center of the roller to an outer circumferential surface of the increase portion is shorter than a radius of the cylinder.

3. The compressor of claim 2, wherein the distance from the rotation center of the roller to the outer circumferential surface of the increase portion is gradually increased toward the decrease portion.

4. The compressor of claim 1, wherein a distance from the rotation center of the roller to an outer circumferential surface of the decrease portion is formed to be the same for at least a portion of the decrease portion.

5. The compressor of claim 4, wherein the distance from the rotation center of the roller to the outer circumferential surface of the decrease portion is formed to be the same as a radius of the cylinder.

6. The compressor of claim 1, wherein a connection portion is formed between the increase portion and the decrease portion, and wherein the connection portion is formed to have a curved surface having a common tangent to the increase portion and the decrease portion at the connection portion.

7. The compressor of claim 1, wherein assuming that a half circumference angle of a contact section of the roller contacting the inner circumferential surface of the cylinder, among the outer circumferential surface of the roller, is D and a circumference angle between a central part of the vane in a lengthwise direction and a compression starting angle is C, the half circumference angle of the contact section satisfies a formula, $D \leq C$.

8. The compressor of claim 1, wherein a suction opening is formed at one side of the vane in a circumferential direction, and wherein a circumference length of a contact section of the roller contacting the inner circumferential surface of the cylinder, among the outer circumferential surface of the roller, is formed to be equal to or smaller than two times of a circumference length from a central part of the vane in a lengthwise direction to a farthest part of the suction opening from the vane.

9. The compressor of claim 1, wherein an oil passage is formed at the rotational shaft, and wherein an oil hole, which communicates with the oil passage and extends to the lubrication surface of the roller contacting the inner circumferential surface of the cylinder, is formed at the roller, and wherein the oil hole extends from the oil passage to the lubrication surface.

10. The compressor of claim 1, wherein the roller includes at least two wing portions formed to extend in a radial direction on the basis of the rotational shaft, wherein the lubrication surface is formed on an outer circumferential surface of each of the at least two wing portions, and wherein the lubrication surfaces of the at least two wing portions are connected to each other by straight lines.

11. A compressor, comprising:

a driving motor;

a rotational shaft configured to transmit a rotational force of the driving motor;

a cylinder installed at one side of the driving motor;

a roller having an outer circumferential surface contacting an inner circumferential surface of the cylinder, rotated by the rotational shaft, and concentric with the cylinder; and at least two vanes movably provided at the cylinder, contacting an outer circumferential surface of the roller, and configured to divide at least two compression spaces formed by the cylinder and the roller into a suction chamber and a compression chamber, wherein the roller includes:

a first curved surface spaced from the inner circumferential surface of the cylinder, wherein the first curved surface has a sum of distances from two points on a line passing through a rotation center of the roller to the outer circumferential surface of the roller being increased, formed on the outer circumferential surface of the roller, and wherein the distance sums that are measured on the outer circumferential surface of the roller starting at a location closer to the minor axis and are compared to the distance sums that are measured closer toward the major axis; and a second curved surface contacting the inner circumferential surface of the cylinder, wherein the second surface has a sum of distances from two points on a line passing through a rotation center of the roller to the outer circumferential surface of the roller is decreased, formed on the outer circumferential surface of the roller, wherein the distance sums that are measured on the outer circumferential surface of the roller starting at a location closer to the minor axis and are compared to the distance sums that are measured closer toward the major axis, and wherein a curvature radius of the second curved surface is formed to be equal to a curvature radius of the inner circumferential surface of the cylinder.

12. The compressor of claim 11, wherein an oil passage is formed at the rotational shaft, and wherein an oil hole, which communicates with the oil passage toward the outer circumferential surface of the roller contacting the inner circumferential surface of the cylinder, is formed at the roller.

13. A compressor, comprising:

a driving motor;

a rotational shaft configured to transmit a rotational force of the driving motor;

a cylinder installed at one side of the driving motor;

a roller having an outer circumferential surface contacting an inner circumferential surface of the cylinder, rotated by the rotational shaft, and concentric with the cylinder; and at least two vanes movably provided at the cylinder, contacting an outer circumferential surface of the roller, and configured to divide at least two compression spaces formed by the cylinder and the roller into a suction chamber and a compression chamber, wherein the roller includes a lubrication surface provided on the outer circumferential surface of the roller in surface-contact with the inner circumferential surface of the cylinder, wherein the lubrication surface has a same radius from a rotation center of the roller and is formed on both sides of a line passing through the rotation center of the roller and two points on a long axis of an ellipse in a circumferential direction, wherein an oil passage is formed at the rotational shaft, and wherein an oil hole, which communicates with the oil passage toward the lubrication surface of the roller contacting the inner circumferential surface of the cylinder, is formed at the roller, and wherein the oil hole extends from the oil passage to the lubrication surface.

* * * * *